US008627641B2

(12) United States Patent
Brander et al.

(10) Patent No.: US 8,627,641 B2
(45) Date of Patent: Jan. 14, 2014

(54) SADDLE

(76) Inventors: Andrew Michael Brander, Haddington (GB); Donna Kaye Brander, Haddington (GB); Tracey Elizabeth Ward, Haddington (GB); Mathew Roger Ward, Haddington (GB)

( * ) Notice: Subject to any disclaimer, the term of this patent is extended or adjusted under 35 U.S.C. 154(b) by 15 days.

(21) Appl. No.: 13/142,646

(22) PCT Filed: Jan. 6, 2010

(86) PCT No.: PCT/GB2010/050015

§ 371 (c)(1),
(2), (4) Date: Jul. 12, 2011

(87) PCT Pub. No.: WO2010/079354

PCT Pub. Date: Jul. 15, 2010

(65) Prior Publication Data

US 2011/0258974 A1 Oct. 27, 2011

(30) Foreign Application Priority Data

Jan. 8, 2009 (GB) ..... 0900241.1

(51) Int. Cl.
*B68C 1/02* (2006.01)

(52) U.S. Cl.
USPC ..... 54/37.1; 54/44.1

(58) Field of Classification Search
USPC ..... 54/44.1, 46.2, 44.5, 44.7, 37.1, 38.1, 54/40.1
See application file for complete search history.

(56) References Cited

U.S. PATENT DOCUMENTS

| | | | | | |
|---|---|---|---|---|---|
| 41,130 | A | * | 1/1864 | Weber et al. | 54/44.1 |
| 796,888 | A | * | 8/1905 | Baker | 54/37.1 |
| 982,975 | A | * | 1/1911 | Moore | 54/37.1 |
| 1,190,023 | A | * | 7/1916 | Simons | 54/37.1 |
| 1,607,906 | A | * | 11/1926 | Murphy | 54/37.1 |
| 3,641,739 | A | * | 2/1972 | Stubben | 54/46.1 |
| 6,523,332 | B1 | | 2/2003 | Erb | |

(Continued)

FOREIGN PATENT DOCUMENTS

| | | | |
|---|---|---|---|
| GB | 2443882 | A | 5/2008 |
| WO | WO-2004/050544 | A1 | 6/2004 |
| WO | WO-2005000966 | A1 | 1/2005 |
| WO | WO-2008/030103 | A1 | 3/2008 |

OTHER PUBLICATIONS

Espeel, Els, "International Search Report", for PCT/GB2010/050015 as mailed Apr. 20, 2010, 3 pages.

(Continued)

*Primary Examiner* — Rob Swiatek
*Assistant Examiner* — Lisa Tsang
(74) *Attorney, Agent, or Firm* — Winstead PC

(57) ABSTRACT

A dynamically rigged load distributing system for an equestrian saddle including several load-bearing sections positioned upon flexible inner side panels to be incorporated in the saddle. Several line guides are fixed respectively to the sections. One or more load distribution lines pass through the guides, and loop around free-running pulleys of the stirrup hanger system. A new stirrup hanger bat includes cliverter pulleys and cooperates with a pulley block to transfer loads through the load-distribution lines to the load-bearing sections around the saddle. A girthing system for the saddle includes webbing attached to the sections so as to depend therefrom and receive ends of girth straps whereby load is transferred to the sections on each side of the saddle.

18 Claims, 9 Drawing Sheets

(56) References Cited

U.S. PATENT DOCUMENTS

| | | | | |
|---|---|---|---|---|
| 7,093,413 | B1 * | 8/2006 | Hughes | 54/44.1 |
| 2005/0037189 | A1 | 2/2005 | Palmer et al. | |
| 2006/0080946 | A1 | 4/2006 | DeCosemo | |
| 2007/0029690 | A1 | 2/2007 | Green et al. | |

OTHER PUBLICATIONS

Palmer, Richard et al., "D3O Energy Absorber", http://www.rexresearch.com/palmerd3o/palmerd3o.htm, Jun. 15, 2011, 15 pages.

* cited by examiner

SADDLE

FIELD OF THE INVENTION

The invention relates to devices for mounting or loading the back of an animal and provides improvements in the methods of mounting girthing straps and stirrups to saddles, and the way in which saddles are correspondingly designed. In particular the invention broadly offers improvements in saddlery and especially provides a new saddle design which allows the horse and rider full range of motion.

BACKGROUND OF THE INVENTION

The evolution of saddles has recently started to gather pace. From the very early saddles, designed purely to provide a more secure seat for the rider, through the development of stirrups, leaving aside pack saddles, there have been three main strands of design: the military, designed to secure the rider firmly and provide a degree of protection; the working or western saddle, also designed to provide a degree of security for the rider; and the English or close contact style where security for the rider is subservient to need for close contact with the animal. All three styles have a solid backbone or "tree", traditionally made of wood (more recently materials have included fiberglass, metal and plastic), round which the leather (or synthetic equivalent) is mounted. Inevitably such a rigid structure placed on a moving surface raises difficulties with the fit of the saddle to the horse. In the case of the military and western saddles this is partially addressed by using a thick saddle blanket. However with close contact saddles the issue is addressed by attention to fit, either by having a bespoke saddle made for the horse (which is very expensive), or by careful selection from a range of off the peg designs. It is estimated that a saddlery wishing to carry a basic range of off the peg saddles, covering the three main saddle styles (dressage, jumping, general purpose), in one single colour option, and to fit most sizes of horse and rider, would have to stock in excess of 72 different saddles.

Even when a rider invests in a bespoke saddle, the traditional, static design based on a rigid tree does not allow for the changes in a horse's shape that occur as it moves, or as there are variations in its fitness. Even the best fitting saddle cannot distribute the pressure evenly throughout the range of a horse's movement, and even a well fitting treed saddle will inevitably create pressure points on the horse's back, especially when turning tightly, where the saddle tree acts somewhat as a splint longitudinally on the spine, or when riding up or down hill or jumping, where the load is focused by the tree towards the front or back of the saddle. This can cause pain and restrict movement, and can potentially leading to a range of physiological and behavioural problems such as bucking, rearing, lameness, bruising of the muscles, muscular atrophy and in more severe cases, tissue necrosis.

Over the last thirty years several new designs of saddle have been developed, both to try to address the problems enumerated above, and to facilitate newly evolved riding disciplines such as endurance and vaulting. All still use a static method of mounting the saddle on the horse. Many of these new designs are described as "treeless", but in practice most are semi-treed, in that they have a rigid internal fitting at either the pommel or the cantle of the saddle. This can lead to weight being distributed over fewer points than a standard tree, which, in some circumstances, can exacerbate the problem. Saddles that have no tree at all do nothing to spread the pressure of the girth and the stirrups, the full force of which is therefore concentrated immediately over the mounting points. There is also a perception that such saddles are not as secure on the horse, as many treeless designs do not include a gullet, which has the effect of reducing lateral stability. A further disadvantage of many such saddles is that it is difficult to design them to look like the traditional English saddle, a look that is very popular in the market.

An additional issue with traditional close contact saddle design is that the mounting position of the stirrups can be quite critical to the ability of the rider to effectively balance on their horse. Many buyers' choice of saddle is primarily based on this factor, in an attempt to ensure that they are able to sit in the ideal position "over" the stirrups. There is little or no allowance in most saddles for any adjustment of the stirrup bar mounting position, so that this factor can quite severely restrict the choice of saddle, and associated ability to ensure a good fit.

In the following discussion, the invention will be generally described in relation to equestrian uses of the invention. However, the invention is broadly applicable to pack animals as well as mounts for personal transport.

An object of the invention is to obviate or mitigate at least some of the aforesaid problems by providing improvements in saddle design.

SUMMARY OF THE INVENTION

This invention provides a dynamic load distribution system for rider and non-rider loads to be borne on the back of an animal whereby localised load pressure points are reduced and flexing of the animal's spine is permitted.

According to a first aspect of the invention, there is provided a system for supporting a load to be carried on the back of an animal, said system comprising a load support surface, first and second opposed side panels extending from the load support surface to facilitate load distribution, fasteners for attaching the system to the back of an animal, and at least one load distribution line and corresponding line guides configured to direct the line around the load support surface and to permit loadings thereon to be distributed around the system by said line(s) so as to reduce localised pressure points upon the back of the animal, while permitting the animal's back to flex.

The load support surface may include a seat. The opposed side panels may be padded or reinforced to maintain a gullet space within predetermined size limitations. Placement of suitable wedges, e.g. juxtaposed with an edge of the side panels may facilitate retention of a desired angular configuration of these side panels e.g. to control height (clearance) and panel pitch. The fasteners may comprise one or more girth straps.

In a preferred form of the invention, the system for supporting a load to be carried on the back of an animal is a saddle without a conventional tree, for a rider using stirrups, wherein the saddle comprises a hidden from view dynamic load distribution system comprising a plurality of load-bearing surfaces within the saddle, said surfaces being located in flexible side panels and mutually spaced thereon, and at least one load distribution line connected to selected ones of the load-bearing surfaces and passing freely around line guides attached to the saddle, said line cooperating with a pulley system provided between the stirrups and the saddle to permit distribution of the loading from the stirrups around the saddle.

According to another aspect of the invention, there is provided a saddle comprising a load support surface including a plurality of load-bearing surfaces mounted upon first and second opposed flexible side panels extending from the load-bearing surfaces, and flexibly connected one to the other, wherein selected ones of said load-bearing surfaces have at least one load distribution line passing thereover, and corresponding line guides configured to direct the line around the load support surface and to permit loadings thereon in use to be distributed around the system by said line(s) so as to reduce localised pressure points upon the back of the animal.

The loadings contemplated may be dependent loadings such as that created by a rider using stirrups or panniers that are dependent ultimately from the load support surface, or downward pressure of a pack supported upon the side panels, or downward pressure exerted by the pull of a girth strap or straps upon the side panels, or simply the weight of a pack or rider upon the load support surface.

The load-bearing surfaces may be flexibly connected one to the next by flexible joints, which may be of a flexible, durable synthetic material such as a plastics material, or a mechanical hinge, optionally incorporating a swivel, made of metal, or a combination of metal and plastics.

The flexible connection may permit at least two planes of freedom of movement. Such a connection may be formed using flexible plastic members or a mechanical coupling having the ability to flex in at least two different planes. A suitable mechanical coupling has a first component having a first pivot axis, and a second component having a second pivot axis, and the said pivot axes are mutually perpendicular. A simple universal joint of the Cardan type, having a first yoke connected to a second yoke through perpendicular hinge pins, is suitable for the purpose.

A load-distribution system as proposed according to the aforesaid aspects of the invention is conveniently incorporated into a saddle without any rigid internal structure in accordance with another aspect of the invention, and comprising a saddle seat with left and right side panels dependent from the seat, wherein the saddle side panels are provided with a means for attaching a girth, and optionally, said panels are adjustably drawn together under the seat to define a gullet.

The saddle may use girth straps of a known type.

The system according to the first aspect is preferably adapted for use by a rider by provision of a unique design of stirrup hanger adapted according to the invention for use with the load distribution line and including line guides to allow the stirrup hanger to be supported by the load distribution line, whereby the system acts as a dynamic rigging system that distributes the load placed in the stirrups through a number of points across the load support surface.

The stirrup hanger may be a bar of an elongate shape having a length, and intermediate that length is provided an aperture e.g. a horizontal slot for receiving a stirrup leather, and at either end of the bar is provided line guide means. The line guide means may comprise sheaves or other roller devices to allow the line to be diverted where necessary whilst remaining essentially free to move back and forth across the guide means.

Whereas a conventional stirrup bar could be used in embodiments of the invention, it is preferred to use the novel stirrup hanger designed for this invention, and to be more particularly described hereinbelow.

The new stirrup hanger may take a variety of suitable shapes, but an oblong flat bar shape may be suitable, with the longer dimension generally being aligned between the head and tail of the animal. The bar is preferably of a suitably strong material such as metal, e.g. stainless steel, or carbon fibre, or a composite material, the said bar being formed with appropriate lightening holes to reduce weight without detriment to strength. At least one aperture in the bar is adapted for suspension of a stirrup leather.

Safety stirrups are preferred for use with the stirrup hanger.

The stirrup hanger may include flexible parts, e.g. hinged end parts.

The ends of the stirrup hanger may be adapted to serve as guides for one or more lines. The ends may be angled to hold a line outwardly and away from the saddle to facilitate free-running of the line, and reduce wear and friction thereupon.

The ends of the stirrup hanger may incorporate roller devices or a contoured configuration adapted to guide a line in a preferred orientation.

The line may be of wire, cable, rope, or strap of sufficient tensile strength, wear resistance and durability to suit the purpose. The line may be a continuous loop.

In particular the use of a line provides a means of adjustably attaching the stirrup hangers to the saddle, and in normal use of the stirrup hangers by a rider whose weight is transferred to the hangers by stirrups dependent therefrom the line, which serves to distribute the various loadings thereon across the saddle by appropriately positioned guides preferably including at least one at the front and one at the back of the saddle. This type of rig for the stirrups also provides a rider with assistance in maintaining balance due to the additional free movement of the stirrup hanger (bar) which will tend to assist the stirrup to naturally fall under the rider's foot.

More than one line may be employed in the system to adjust the positioning of the stirrup bar, and improve control and distribution of different loadings.

The line guides are conveniently made of, or coated with, a low friction or slip-promoting material to allow the line to freely move over the guide surface, but may include rolling elements e.g. pulleys around which the line may be freely drawn to respond to loadings upon the line. The line guides or runners may include D-rings, O-rings, and tubular sleeve or sheath elements. Smooth or polished metal, ceramics or plastics and resinous materials may be used to form the guides. Such may be made from or optionally coated with slip enhancing materials such as polyamides (Nylon), fluorinated plastics (Teflon), molybdenum disulphide etc.

The use of a line to distribute loadings around the saddle permits a more flexible and dynamically responsive saddle to be designed without the need to include a tree or the like support frame elements.

In accordance with a further aspect of the invention, girth straps may be attached to selected parts of the flexible side panels of the load distribution system by means of webbing configured to distribute loadings from the girth over the flexible side panels. Adoption of a "W" configuration for at least part of the webbing is convenient for load distribution from two girth straps.

In most cases use of a saddle that has a gullet, i.e. some clearance between the seat and the back of the mount, is preferred.

Conveniently, the gullet is formed by controlling the lateral spacing between the side panels, which when positioned in relation to a mount, has an impact on the vertical gullet clearance.

The amount of adjustment to the gullet may be controlled at least in part by introduction of padding juxtaposed with the side panels and seat support, e.g. beneath the pommel and/or cantle of a saddle. Preferably any such padding is at least present beneath the pommel to ensure sufficient clearance of the withers (maximum height over the 3rd, 4th, and 5th thoracic vertebrae). Optionally a further line may join the two side panels in an adjustable manner enabling the panels to be drawn together or spaced apart to suit use on a variety of mounts by adjusting the gullet size. Alternatively, instead of a further line, strapping with adjustable contact fasteners e.g. of the "hook and loop" type pads available under the trade mark Velcro, might be usefully employed to improve control over the width of the gullet.

The side panels may be provided with extensions or skirts and may include flexible gussets or separable or stretchable sections to enhance flexibility and mobility.

A saddle adopting features of the above-mentioned aspects of the invention may comprise a layered arrangement of an outer surface and filler materials within.

It will be understood that whilst the saddle is made from flexible materials, it is substantially incompressible longitudinally in normal usage. This longitudinal retention of shape and dimensions is in part attributable to the formation of the seat e.g. foam cut in a predetermined manner to suit purpose, and strategic positioning of optional stiffener elements, whereby care is taken to inhibit front to back compression, whilst allowing full dorsal, ventral and lateral flexion with sufficient rotational flexibility.

Leather or a hard-wearing synthetic fabric is traditionally used as the outer surface material, and wool or synthetic filler materials such as polymer resin foams e.g. polyurethanes, may form the basis for inner layers. Optionally, metal or plastics stiffener elements may be incorporated to improve the shape of parts of the saddle without unduly compromising the overall flexibility of the saddle derived from use of a load distribution line system instead of a traditional tree.

A suitable flexible material which may be used in the saddle is the material d3o® which has been described as an advanced polymer with shear thickening properties, and which is normally flexible, but is capable of withstanding shocks. Such materials are described in WO2005000966, the contents of which are incorporated by reference, and generally comprise a 15 composite material which is elastic, which exhibits a resistive load under deformation which increases with the rate of deformation, which is unfoamed or foamed, comminuted or uncomminuted and which comprises i) a first polymer-based elastic material and ii) a second polymer-based material, different from i), which exhibits dilatancy in the absence of i) wherein ii) is 20 entrapped in a solid matrix of i), the composite material being unfoamed or, when foamed, preparable by incorporating ii) with i) prior to foaming.

DESCRIPTION OF THE DRAWINGS

The invention will now be further described by way of example with reference to the accompanying drawings in which.

MODES FOR CARRYING OUT THE INVENTION

Figure 1:
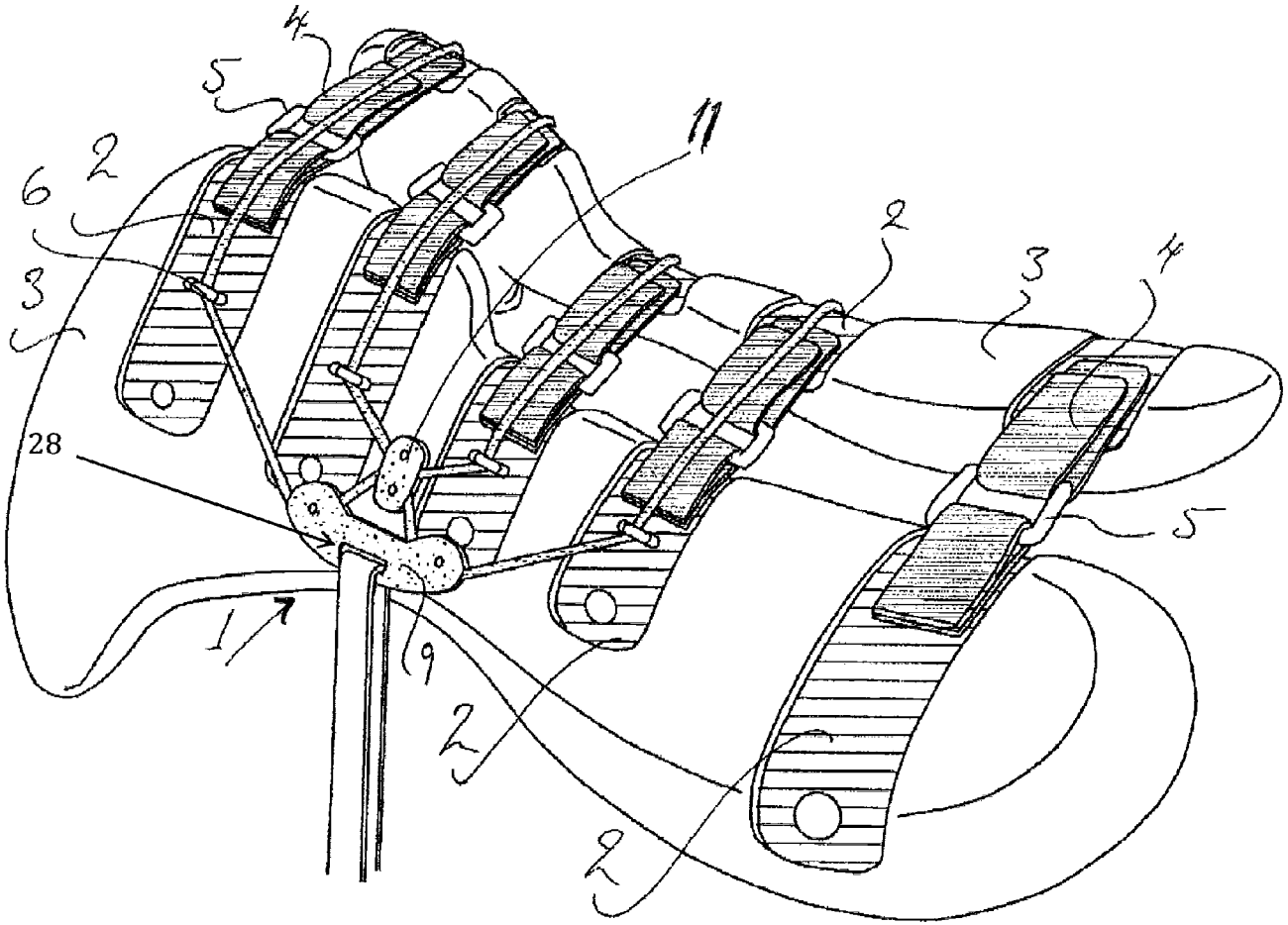
FIG. 1 shows a perspective view from above and from the rear to one side of a load-distribution system suitable for incorporation in a saddle showing stirrup leathers on one side passing through a new stirrup hanger bar.
Figure 2:
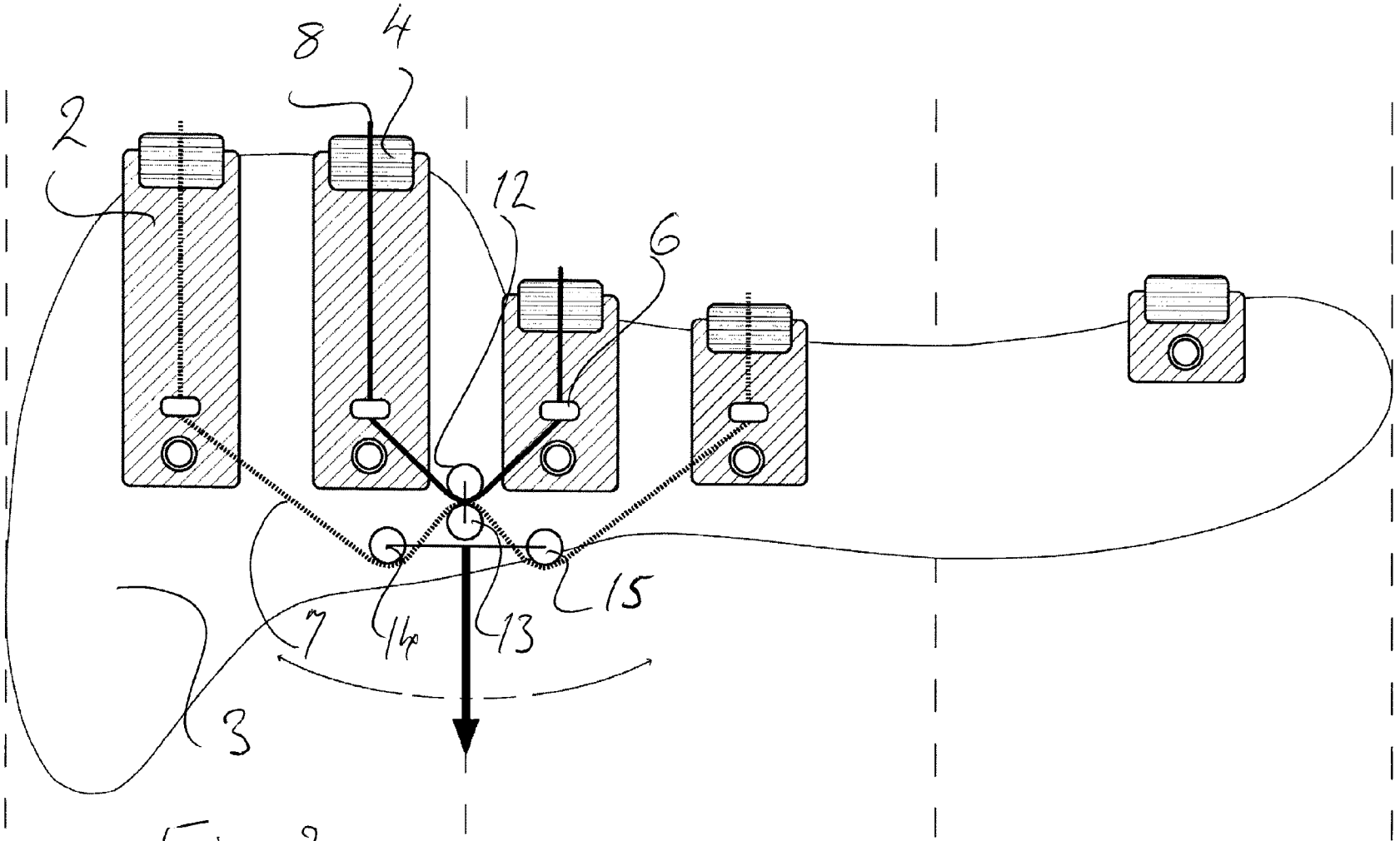
FIG. 2 shows a schematic side view of load-bearing parts of a load distribution system such as that of FIG. 1 for a saddle or the like using several mutually spaced load-bearing surfaces, and two continuous loop load-distribution lines freely running through eyelets and roller devices.

In an embodiment of the invention as illustrated in FIG. 1 and FIG. 2, a dynamically rigged stirrup hanger system 1 for use in an equestrian saddle includes a plurality of load-bearing sections 2 positioned upon respective flexible inner side panels 3 intended to be incorporated during the making of the saddle. The panels 3 are fastened together by durable wear-resistant strapping 4 at the upper edges using buckles 5. A plurality of line guides in the form of eyelets 6 are fixed respectively to the load-bearing sections 2. First and second high tensile load distribution lines 7 and 8, which may be wire cable or fine nylon rope, are fed through the eyelets 6, and loop around free-running pulleys of the stirrup hanger system 1.

The pulleys are provided in part within a stirrup hanger bar 9 of a novel design according to an aspect of this invention incorporating at each end, diverter pulleys 14, 15, including sheaves or the like roller devices, and a tandem pulley block 11 of a known design, with upper and lower pulleys 12, 13 including sheaves or the like roller devices.

Figure 7:
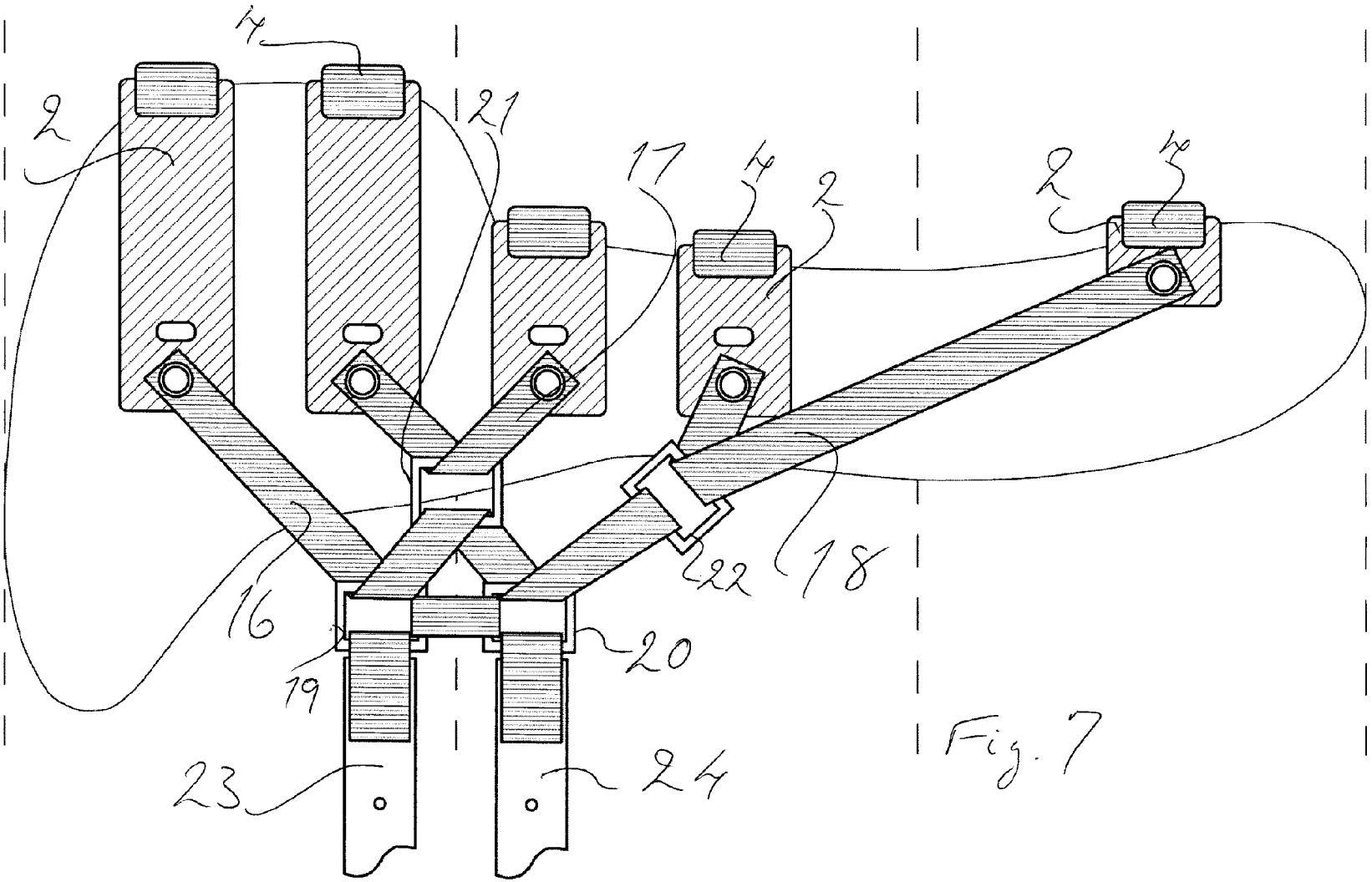
FIG. 7 shows a "W"-style girthing support system of webbing attached to load-bearing surfaces, which is suitable for use in any of the embodiments of the invention.

Referring now to FIG. 7, a girthing system for use with the load distribution system described above comprises webbing 16, 17, 18 attached to the load-bearing sections 2 so as to depend therefrom and form a generally W-shaped configuration to which the ends of the girth straps 23, 24 can be fastened through buckles 19, and 20, and the load transferred at least in part through buckles 21 and 22 through the webbing to the load-bearing sections 2 on each side of the saddle.

Figure 8:
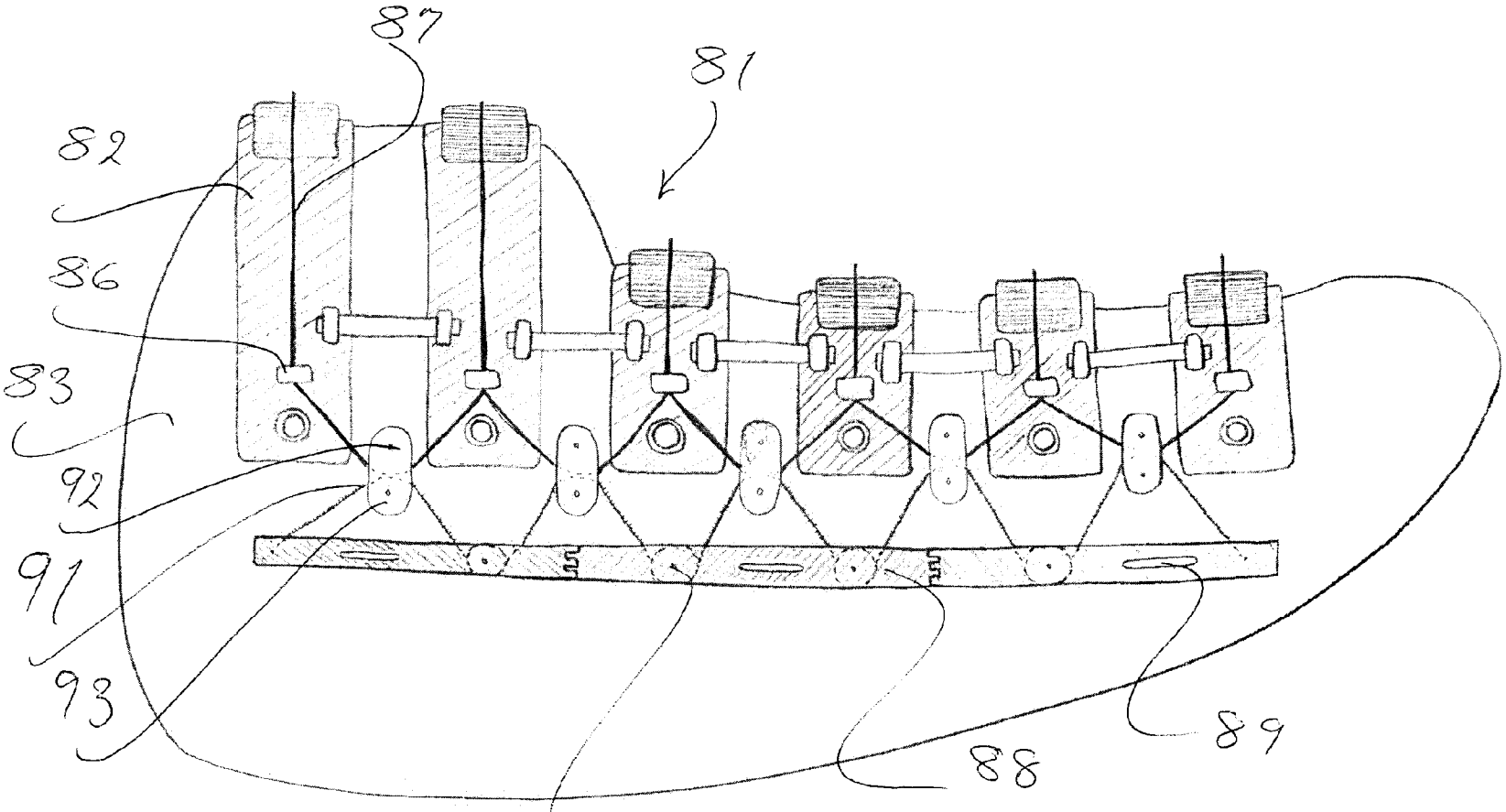
FIG. 8 shows a schematic side view of load-bearing parts of a load distribution system such as that of FIG. 1 and intended for supporting a pannier.

Referring now to FIG. 8, which shows an embodiment for bearing non-rider loads, a dynamically rigged pannier support system 81 includes a plurality of load-bearing flexibly-connected sections 82 positioned upon respective flexible inner side panels 83 intended to be incorporated during the making of the saddle. At least one load distribution line 87, which may be wire cable or fine nylon rope, is fed through eyelets 86, to form a continuous loop around free-running pulleys.

The pulleys are provided in part within an extended pannier hanger bar 88 formed from three pin-hinged elements each incorporating apertures 89 for strapping on a pannier (not shown) or pack load and pulleys 84, including sheaves or the like roller devices, and several tandem pulley blocks 91 of a known design, with upper and lower pulleys 92, 93 including sheaves or the like roller devices.

A greater or fewer number of elements may be used for the pannier bar 89. In this embodiment, each end element houses a pulley and a line attachment point, whilst the intermediate element houses two pulleys. As illustrated one continuous line 87 runs from the line attachment point at the front of the pannier bar, through the free-hanging pulleys, back down through the pulley on the pannier bar, up to the next hanging pulley, and continues in this fashion until the line attachment point at the rear of the pannier bar.

In this example there are three holes in the pannier bar, suitable for attaching the load but other embodiments may utilise buckles, 'D' rings, or other methods suitable for affixing a load to the pannier bar.

A key difference between carrying a load and carrying a rider, is that the centre of mass of a non-rider load may be located centrally on the saddle, as opposed to the centre of mass of the rider in the stirrups which is located ⅓ of the way along the saddle from the front. This allows the lines supporting a non-rider load to be derived from points located symmetrically along the length of the saddle.

Figure 3:
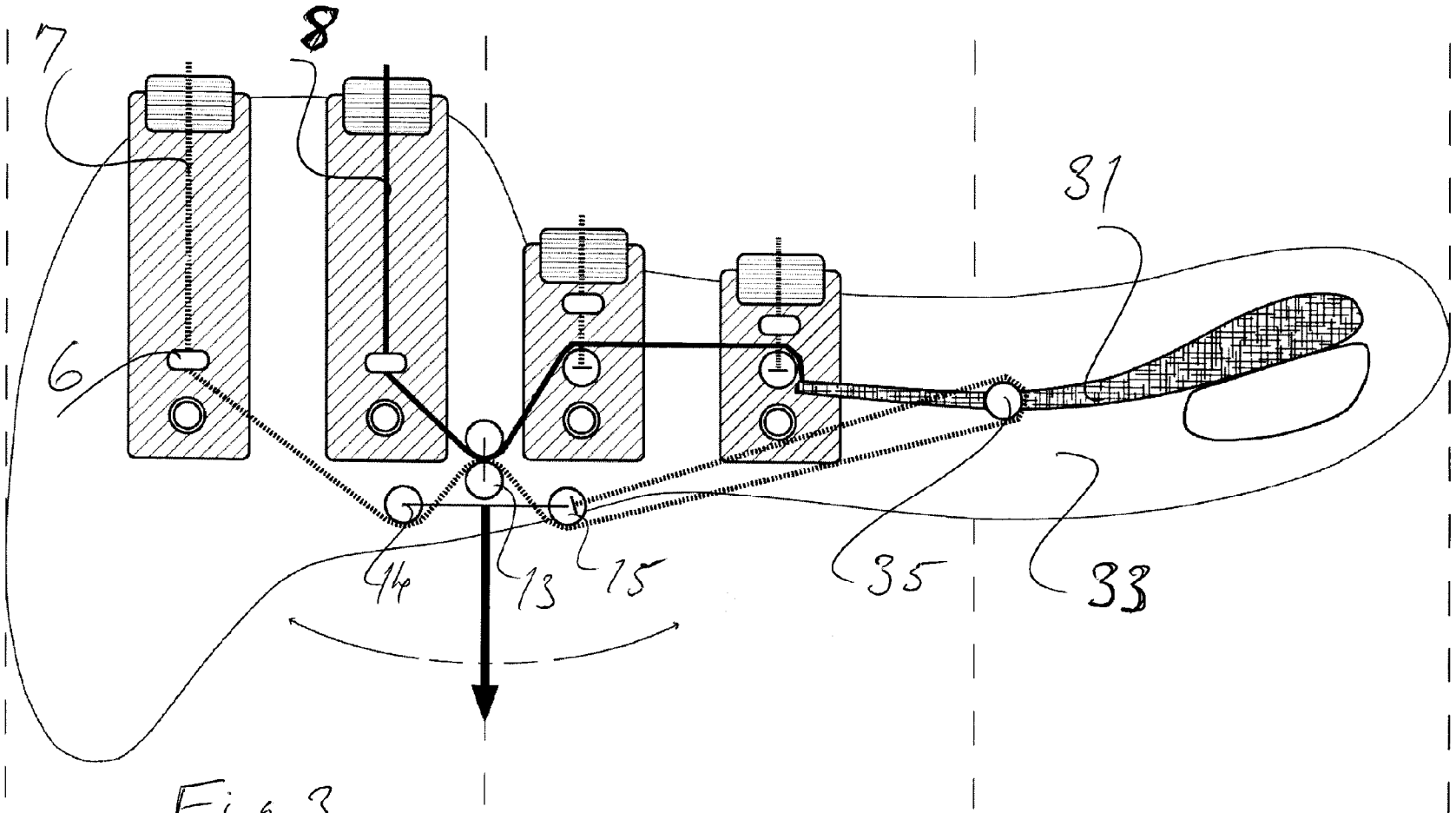
FIG. 3 shows a schematic side view of load-bearing parts of an alternative load distribution system for a saddle or the like using several mutually spaced load-bearing surfaces, and several load-distribution lines freely running through eyelets and roller devices with free ends secured at anchor points.

A greater or fewer number of pulleys and attachment points may be used in other embodiments of the pack saddle Many variants of the dynamic load distribution system are possible within the scope of the invention According to another embodiment of the dynamic load distribution system for use in a saddle which is similar to the system illustrated in FIGS. 1 and 2, is illustrated in FIG. 3. In this embodiment, stirrup loads are additionally distributed further towards the cantle by provision of a stiffener element 31, disposed within the length of a side panel 33 and having a pulley 35 mounted thereon. Free ends of the load-distribution lines are secured at appropriate anchor points. Otherwise the embodiment is generally similar to that of FIG. 1 and in FIG. 3, like reference numerals refer to like parts in this and other figures.

Figure 4:
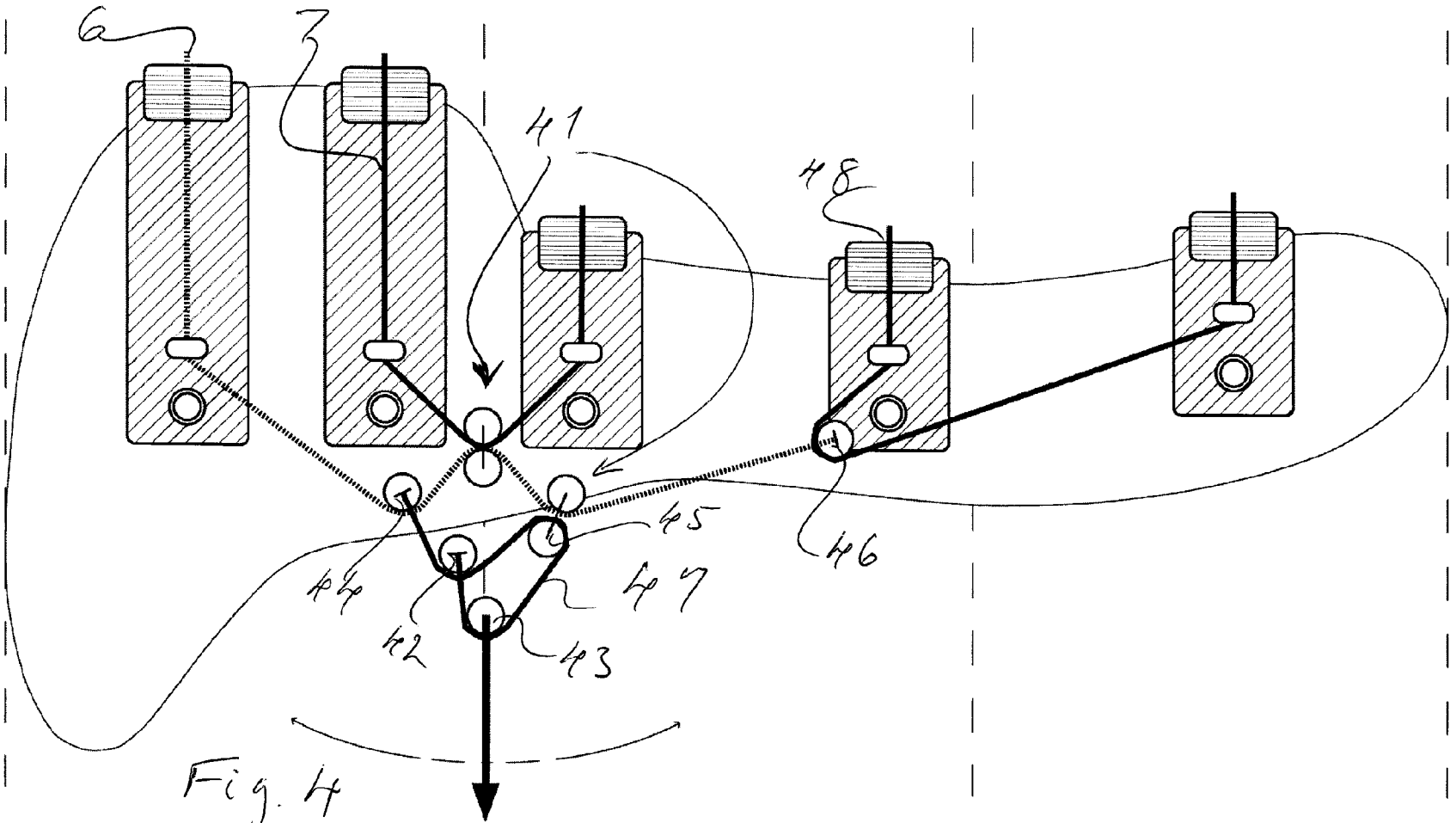
FIG. 4 shows a schematic side view of load-bearing parts of an alternative load distribution system for a saddle or the like using several mutually spaced load-bearing surfaces, and several load distribution lines freely running through eyelets and roller devices.

According to a still further embodiment of the dynamic load distribution system for use in a saddle as shown in FIG. 4, the dynamic load distribution system is further developed to distribute stirrup loads throughout the saddle from pommel to cantle by provision of additional lines 47, 48 and pulley blocks 41 using an alternative means for hanging the stirrups upon the system, where for ease of illustration, only the pulleys 42, 43, 44, 45, 46, thereof are shown to allow visualisation of the arrangement of the lines.

Figure 5:
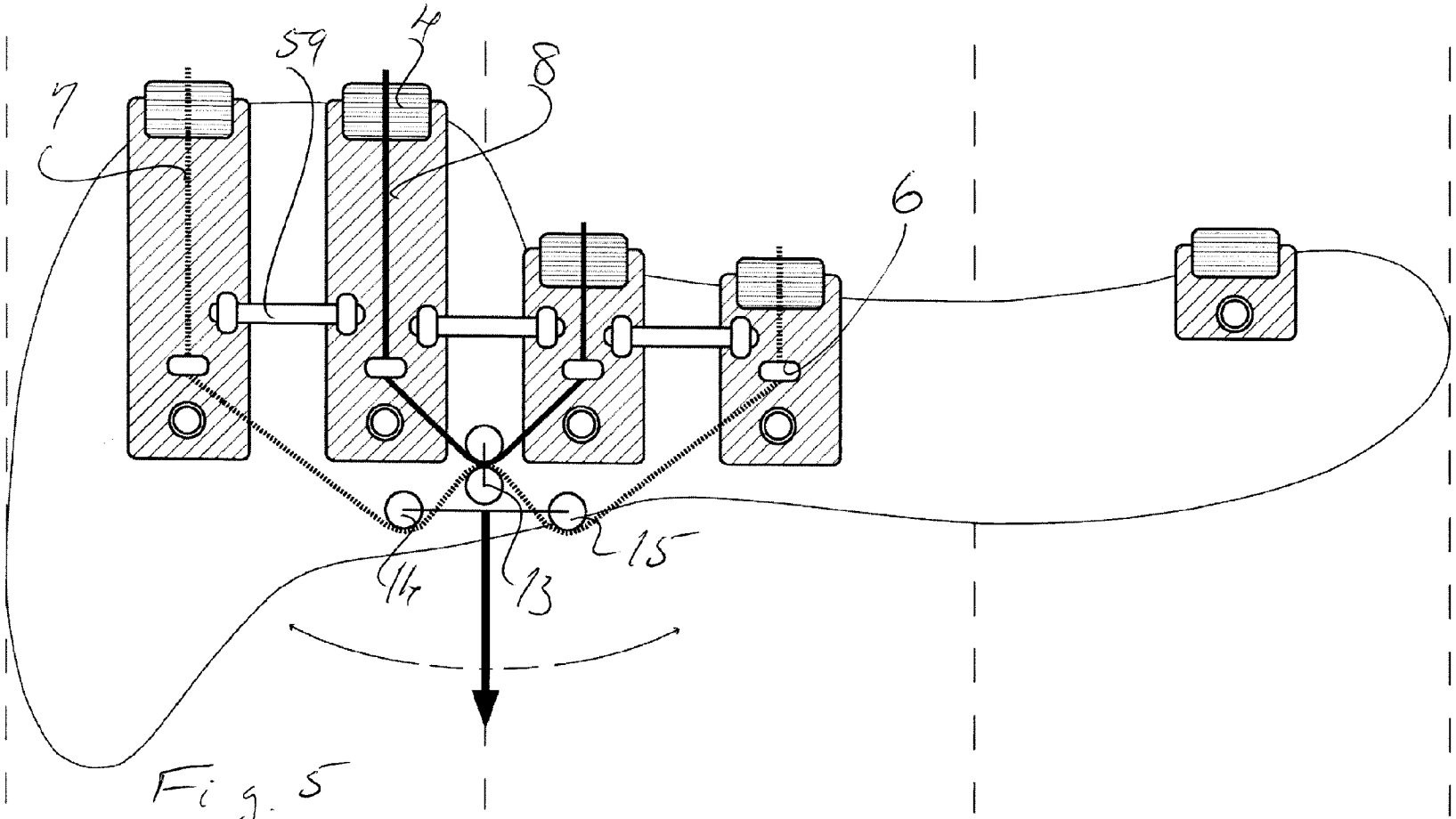
FIG. 5 shows a schematic side view of load-bearing parts of a load distribution system for a saddle or the like using several mutually spaced and flexibly interconnected load-bearing surfaces, and two continuous loop load-distribution lines freely running through eyelets and roller devices.
Figure 6A:
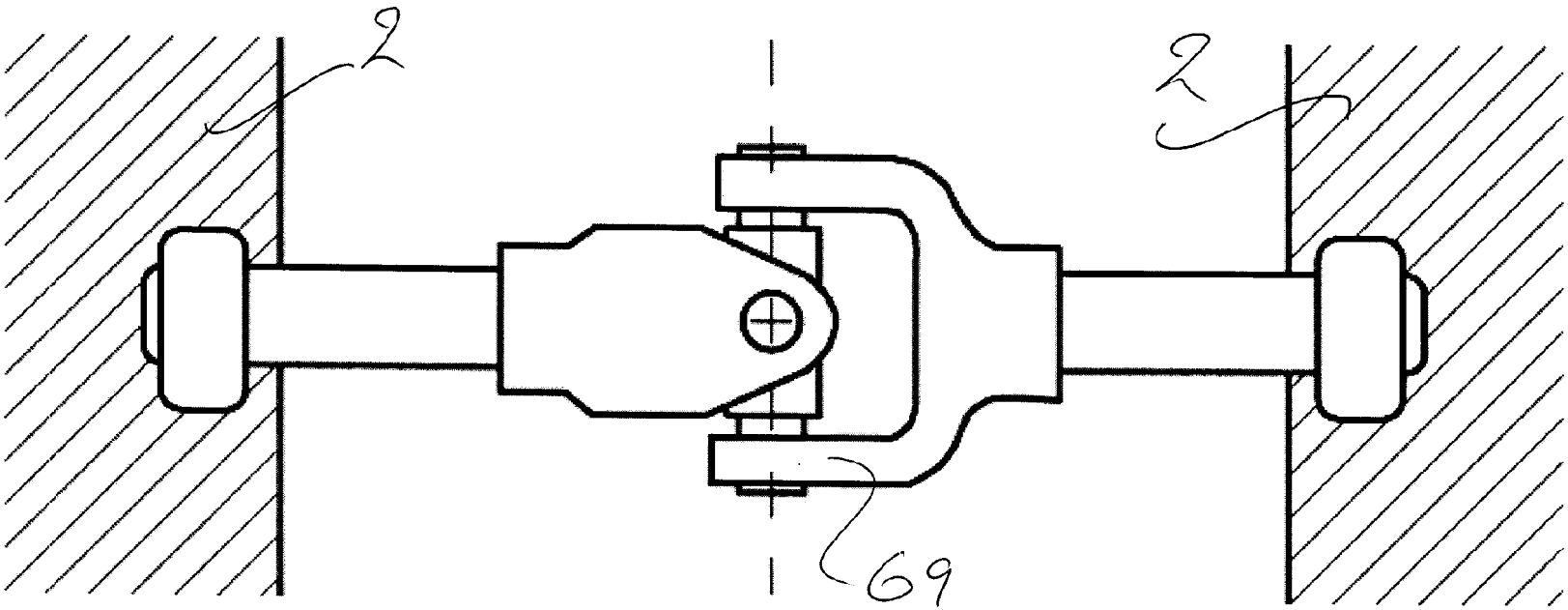
FIGS. 6*a* and 6*b* show an example of one form of flexible connection for use in interconnecting adjacent load-bearing surfaces.
Figure 6B:
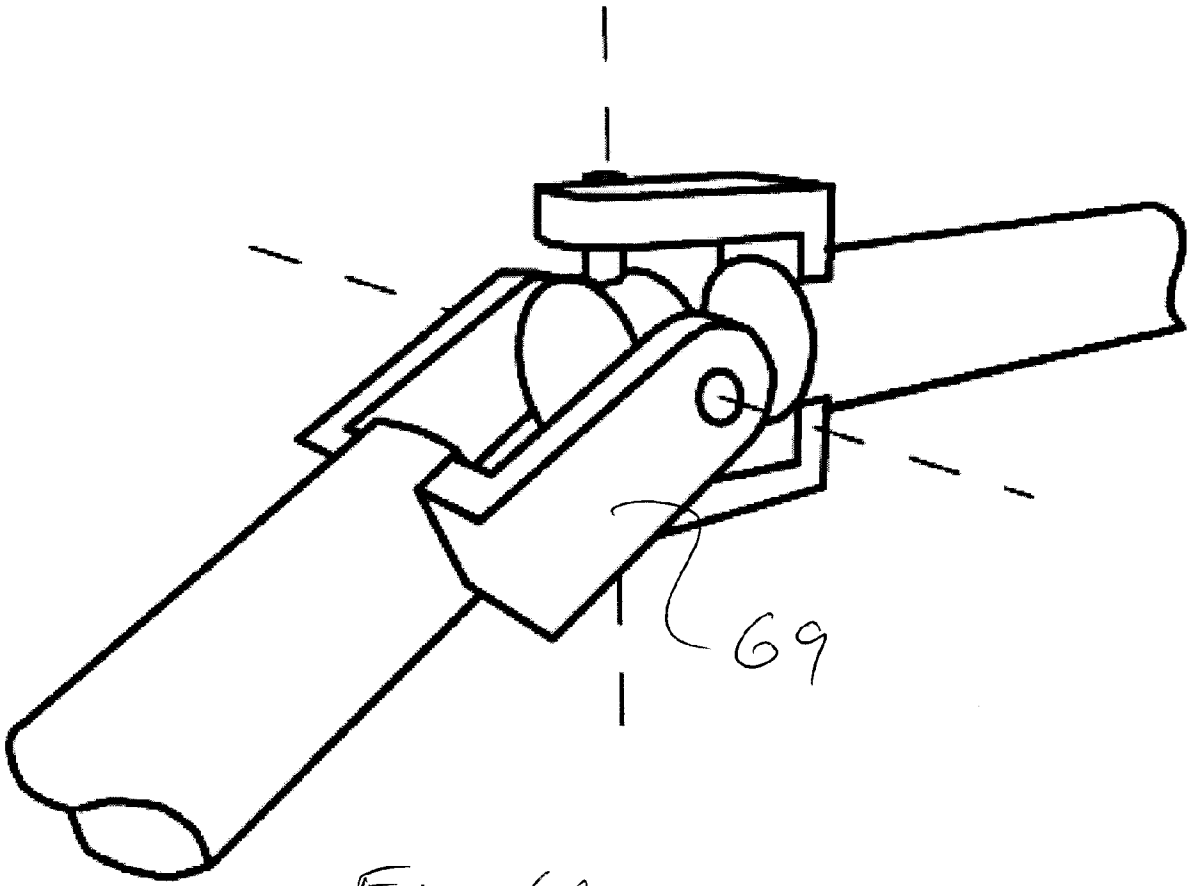

According to yet another embodiment of the dynamic load distribution system for use in a saddle as shown in FIG. 5, the load-bearing sections 2 of the panels 3 are connected one to the next by flexible plastics members 59 which act as universal joints permitting multiple degrees of freedom of motion.

In other embodiments, the flexible plastics members 59 may be substituted by mechanical couplings such as the pivotal link 69 which has cooperating yokes each respectively providing a first component having a first pivot axis about a hinge pin, and a second component having a second pivot axis about a further hinge pin, wherein the said pivot axes are mutually perpendicular.

The above described dynamic load distribution systems can be incorporated into a saddle (not shown) of conventional outward appearance, comprising a seat from which depend two flexible back pads with wedge shaped padding introduced beneath the pommel to ensure the provision of a gullet of adequate clearance of the withers when the saddle is used upon a horse. The seat is contoured to improve rider comfort and rises in a curve to the cantle. The saddle is formed mainly from leather with the seat conveniently including a foam plastics material within the leather.

In this way a saddle of an appearance to which the market is accustomed and favourably disposed is provided. However, significant technical advantages are obtained as explained hereinbelow.

In use, the pressure applied through the girth straps and load distribution line system in conjunction with the padding selectively maintains the gullet at the desired clearance of the withers on a wide variety of horses. This clearance defined between the ceiling of the gullet and side walls of the padding and above the spine of the horse spaces the seat of the saddle from the horse, and avoids the direct weight of the rider being localised upon a few vertebrae which would otherwise cause severe discomfort to the horse and shorten its working life.

The arched and contoured form of the saddle is defined by the combination of leather and wool materials used in its make up and the spacing between the back pads defines the gullet which provides lateral stability to the saddle without requiring a tree or the like rigid steel or wooden frame commonly used in the prior art.

Appropriate choice of the thickness, and angular shape and disposition of the foam padding contributes to appropriate control of the spacing forming the gullet, and wedges of various thicknesses may be adopted to achieve satisfactory performance.

Attachment of stirrups is provided for as illustrated in FIG. 1 by means of a novel stirrup hanger replacing the normal stirrup bar, and associated line rigging system as shown in use in any of the FIGS. 1 to 5.

Referring again to FIG. 1 and FIG. 2, a dynamic rigging system for distribution of dependent loads such as those applied through stirrups includes a pulley block 11 attached in a recessed position under the saddle seat, a stirrup hanger bar 9 positioned to one side beneath the seat and side panel of the back pad (left hand side of system shown). A free-running line 7, 8 in the form of a wire or nylon rope is passed through and around guide means including the pulley block 11, and the end diverter pulleys 14, 15 of the stirrup hanger bar 9 on that side, and around the saddle seat to the other side where identical parts mirror the side shown in FIG. 1. The lines 7, 8 pass near the pommel but not the cantle in this embodiment. In this way the load is distributed across the saddle and localised pressure points are reduced by way of re-distribution of the load around the saddle through the lines 7, 8 and guides in the form of the eyelets 6, and pulleys, 12, 13, 14, 15.

The stirrup hanger bar in this embodiment is of stainless steel with appropriate lightening holes to reduce weight without detriment to strength. At least one aperture 28 in the bar is adapted for suspension of a stirrup leather.

In view of the novel shape of the stirrup hanger, which does not include a safety latch of the usual stirrup bar to allow release of stirrup leathers, it is envisaged that safety stirrups (not shown) which are well known in equestrian circles would commonly be used.

Additional or alternative pulley mounting positions (not shown) permits greater customisation of the saddle to tailor it to a particular rider's needs, or to provide for adjustment to permit more than one rider to customise the saddle in turn.

In equestrian use, the rider would be mounting and riding as usual but would find it more comfortable and the comfort and performance of the horse would be improved due to the improved mobility, and reduced likelihood of injury and discomfort provided by the saddle of this invention.

Various advantages are evident due to the invention including the following.

The invention spreads the load imposed by the girth and/or stirrups bearing the weight of the rider. This invention addresses the problem of pressure points caused by ill fitting saddles, allows for easier and less bespoke saddle fitting, improves freedom of movement in the horse or other animal to which the saddle is fitted, reduces the likelihood of behavioural problems arising due to discomfort, and increases the range of stirrup mountings where the rider is properly positioned 'over' the stirrups.

The avoidance of a rigid frame or tree, and adoption of the load distribution line system in the saddle allows the saddle to move more sympathetically and harmoniously with the horse and rider movements, thereby greatly reducing inhibitions upon horse movement, mitigating fatigue, reducing injury and behavioural issues, while allowing improved responsiveness to rider control, ultimately increasing rider safety.

A further advantage of this approach to the described manner of stirrup attachment is that, by providing for alternative pulley mounts, the natural position of the stirrups can be altered to suit individual rider preferences. This extends a rider's choice of saddle within a particular range.

The examples described above involve the use of ropes and pulleys, but any moveable method of suspensive mounting familiar to one skilled in the art would achieve the same dynamic effect, for instance a cable sliding within a sheath mounted on fixed sheaves.

The invention is not restricted to use on horses, and will work equally well in any other circumstances e.g. for use on mules, donkeys or other pack animals where a saddle or backpack is used and it is desirable to distribute the pressure of the mounting or of stirrups as appropriate. This would include girthing of pack saddles and mounting of packs themselves. Thus the preferred girthing and stirrup mountings can be independently used to benefit with a suitably adapted load distribution line and guide system of this invention.

The invention claimed is:

1. A dynamically-rigged system for supporting a load to be carried on a back of an animal, said system comprising:

a plurality of load-bearing surfaces upon first and second opposed flexible side panels extending from the plurality of load-bearing surfaces, said first and second opposed flexible panels being flexibly connected one to the other;

fasteners for attaching the plurality of load-bearing surfaces to the back of the animal; and at least one load distribution line; and a plurality of line guides that change a direction of at least one load applied to the at least one load distribution line and that direct the at least one load distribution line around the plurality of load-bearing surfaces;

wherein the load applied to the at least one load distribution line is distributed among the plurality of load-bearing surfaces by said at least one load distribution line.

2. A saddle comprising:

a dynamically rigged load support system comprising:

a plurality of load-bearing surfaces upon first and second opposed flexible side panels, the first and second opposed flexible side panels extending from the plurality of load-bearing surfaces, the first and second opposed flexible side panels being flexibly connected one to the other;

wherein selected ones of said plurality of load-bearing surfaces have at least one load distribution line passing thereover; and a plurality of line guides coupled to selected ones of the plurality of load-bearing surfaces and that change a direction of at least one load applied to the at least one load distribution line, the plurality of line guides directing the at least one load distribution line around the plurality of load-bearing surfaces;

wherein the load applied to the at least one load distribution line is distributed to the plurality of load-bearing surfaces by said at least one load distribution line.

3. The saddle claimed in claim 2, wherein selected ones of the plurality of line guides are adapted for attachment of stirrups.

4. The saddle claimed in claim 3, wherein each of the selected ones of the line guides comprises an elongate bar including within its length an aperture for passing a stirrup leather through, and at each end of the bar there is housed a pulley for receiving a load distribution line.

5. A saddle as claimed in claim 2, wherein a girth is attached to selected ones of the plurality of load-bearing surfaces by means of a webbing configured to distribute loading from the girth to each of the selected load-bearing surfaces.

6. The saddle claimed in claim 2, wherein the plurality of load-bearing surfaces are flexibly connected one to the next.

7. The saddle claimed in claim 6, wherein the plurality of load-bearing surfaces are connected one to the next by flexible plastic members.

8. The saddle claimed in claim 6, wherein the plurality of load-bearing surfaces are connected one to the next by a mechanical coupling having the ability to flex in at least two different planes.

9. The saddle claimed in claim 8, wherein:

the mechanical coupling comprises a first component having a first pivot axis, and a second component having a second pivot axis; and the first pivot axis and the second pivot axis are mutually perpendicular.

10. The saddle claimed in claim 2, wherein the saddle is without an internal tree.

11. The saddle claimed in claim 6, wherein the plurality of load-bearing surfaces are connected by flexible plastics members or by a mechanical coupling having the ability to flex in at least two different planes.

12. The saddle claimed in claim 2, comprising a flexible material incorporating a dilatant material.

13. A saddle comprising:

a dynamic load distribution system comprising a plurality of load-bearing surfaces upon first and second opposed flexible side panels extending from the plurality of load-bearing surfaces;

a plurality of line guides coupled to selected ones of the plurality of load-bearing surfaces;

a plurality of load distribution lines passing freely around the plurality of line guides; and a pulley system engaged with the plurality of load distribution lines to permit re-direction and distribution of a load placed on the plurality of load distribution lines to the plurality of load-bearing surfaces.

14. The saddle claimed in claim 13, wherein the pulley system comprises an elongate bar including within its length an aperture for passing a stirrup leather through, and at each end of the elongate bar there is housed a diverter sheave, for receiving one of the plurality of load distribution lines, and a pulley block comprising sheaves in tandem for distributing load between first and second load distribution lines.

15. A saddle as claimed in claim 13, wherein a girth is attached to selected ones of the plurality of load-bearing surfaces by means of webbing configured to distribute loading from the girth to each of the selected load-bearing surfaces.

16. The saddle claimed in claim 13, wherein the plurality of load-bearing surfaces are flexibly connected one to the next by elements permitting a least two degrees of freedom of movement.

17. A dynamically rigged system for supporting a load to be carried on a back of an animal, said system comprising:

a plurality of load-bearing surfaces;

first and second opposed flexible side panels extending from the plurality of load-bearing surfaces, the first opposed flexible side panel and the second opposed flexible side panel being flexibly connected one to the other;

a plurality of line guides coupled to the plurality of load-bearing surfaces, at least one line guide of the plurality of line guides being present on each load-bearing surface of the plurality of load-bearing surfaces; and at least one load distribution line engaged with the plurality of load-bearing surfaces, at least one line guide of the plurality of line guides being provided upon each load-bearing surface of the plurality of load-bearing surfaces;

wherein the plurality of line guides change a direction of at least one load applied to the at least one load distribution line and direct the at least one load distribution line around the plurality of load-bearing surfaces.

18. A saddle comprising:

a load support surface, the load support surface comprising a plurality of load-bearing surfaces;

a first flexible side panel and a second opposed flexible side panel extending from the plurality of load-bearing surfaces, the first flexible side panel and the second opposed flexible side panel being flexibly connected one to the other;

a plurality of line guides coupled to selected ones of the plurality of load-bearing surfaces; and at least one load distribution line directed around the plurality of load-bearing surfaces by the plurality of line guides;

wherein a load applied to the at least one load distribution line is dynamically re-directed and re-distributed among the plurality of load-bearing surfaces so as to reduce localized pressure points upon a back of an animal.

* * * * *

UNITED STATES PATENT AND TRADEMARK OFFICE

CERTIFICATE OF CORRECTION

PATENT NO. : 8,627,641 B2
APPLICATION NO. : 13/142646
DATED : January 14, 2014
INVENTOR(S) : Brander et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 19 days.

Signed and Sealed this
Twenty-second Day of September, 2015

Michelle K. Lee

Michelle K. Lee
*Director of the United States Patent and Trademark Office*